US005900843A

United States Patent [19]

Lee

[11] Patent Number: 5,900,843

[45] Date of Patent: May 4, 1999

[54] AIRBORNE VHF ANTENNAS

[75] Inventor: J. J. Lee, Irvine, Calif.

[73] Assignee: Raytheon Company, Lexington, Mass.

[21] Appl. No.: 08/820,488

[22] Filed: Mar. 18, 1997

[51] Int. Cl.[6] ..... H01Q 13/10

[52] U.S. Cl. ..... 343/767; 343/771; 333/237

[58] Field of Search ..... 343/767, 771, 343/768; 333/237, 26, 248, 21 R; H01Q 13/10

[56] References Cited

U.S. PATENT DOCUMENTS

| | | | |
|---|---|---|---|
| 2,908,000 | 10/1959 | Robinson, Jr. | 343/767 |
| 2,996,715 | 8/1961 | Rumsey et al. | 343/767 |
| 3,150,375 | 9/1964 | Bevan et al. | 343/771 |
| 3,512,161 | 5/1970 | Jennetti | 343/771 |
| 3,978,485 | 8/1976 | Bonnaval | 343/767 |
| 4,330,784 | 5/1982 | Ryno et al. | 343/771 |
| 4,410,890 | 10/1983 | Davis et al. | 343/767 |
| 4,451,830 | 5/1984 | Lucas et al. | 343/768 |
| 5,717,410 | 2/1998 | Ohmine et al. | 343/771 |
| 5,717,411 | 2/1998 | Knop et al. | 343/767 |

FOREIGN PATENT DOCUMENTS

| | | | |
|---|---|---|---|
| 2 192 490 | 1/1988 | United Kingdom | H01R 9/16 |

*Primary Examiner*—Don Wong
*Assistant Examiner*—Hoang Nguyen
*Attorney, Agent, or Firm*—Leonard A. Alkov; Glenn H. Lenzen, Jr.

[57] ABSTRACT

A compact high gain VHF antenna for airborne synthetic aperture radar to detect targets concealed behind trees and forests. The antenna is formed by cutting a slotline in the middle of the top wall of a very thin waveguide along its axis. The waveguide can be folded and mounted on the underside of the wings of an aircraft with minimum protrusion and wing drag. The antenna produces a downward and side-looking beam with horizontal polarization for maximum foliage penetration and target detection. The antenna design can be scaled to any frequency for ground based and shipboard applications.

25 Claims, 6 Drawing Sheets

FIG. 6.
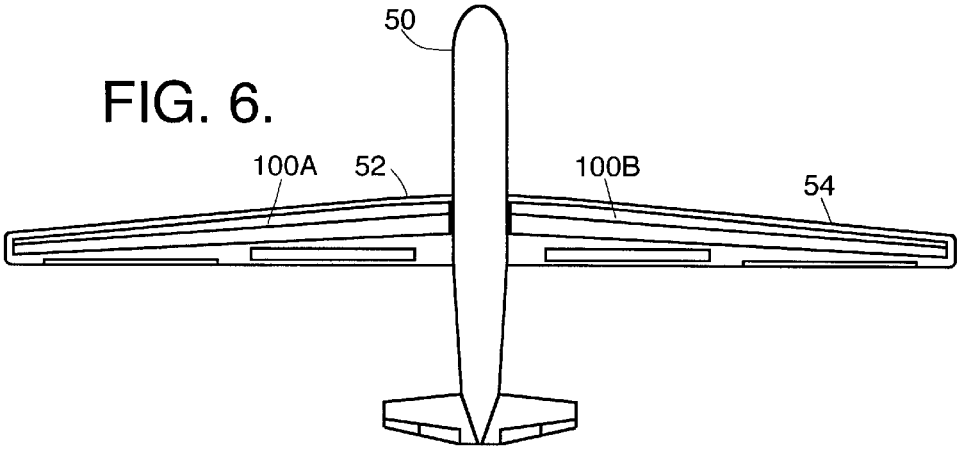
FIG. 7.
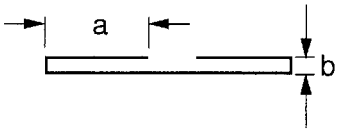
FIG. 8.
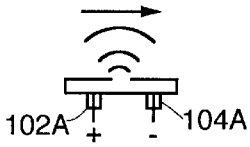
FIG. 9.
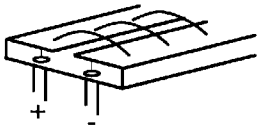
FIG. 10.
| FREQ (MHz) | WIDTH a (in) | Index n | Theta in | Theta out |
|---|---|---|---|---|
| | | | | |
| 75 | 60 | 1.4 | 20.5 | 29.4 |
| 76 | 60 | 1.4 | 22.5 | 32.3 |
| 77 | 60 | 1.4 | 24.2 | 35.0 |
| 78 | 60 | 1.4 | 25.8 | 37.5 |
| 79 | 60 | 1.4 | 27.2 | 39.9 |
| 80 | 60 | 1.4 | 28.6 | 42.1 |
| 81 | 60 | 1.4 | 29.9 | 44.2 |
| 82 | 60 | 1.4 | 31.1 | 46.3 |
| 83 | 60 | 1.4 | 32.2 | 48.2 |
| 84 | 60 | 1.4 | 33.3 | 50.2 |
| 85 | 60 | 1.4 | 34.3 | 52.0 |
| 86 | 60 | 1.4 | 35.2 | 53.9 |
| 87 | 60 | 1.4 | 36.2 | 55.7 |
| 88 | 60 | 1.4 | 37.0 | 57.5 |
| 89 | 60 | 1.4 | 37.9 | 59.3 |
| 90 | 60 | 1.4 | 38.7 | 61.1 |
| 91 | 60 | 1.4 | 39.5 | 62.9 |
| 92 | 60 | 1.4 | 40.2 | 64.7 |
| 93 | 60 | 1.4 | 41.0 | 66.6 |
| 94 | 60 | 1.4 | 41.7 | 68.5 |

AIRBORNE VHF ANTENNAS

TECHNICAL FIELD OF THE INVENTION

This invention relates to airborne VHF antennas, and more particularly to a compact high gain VHF antenna useful for airborne synthetic aperture radar (SAR).

BACKGROUND OF THE INVENTION

VHF antennas are normally long and bulky because the wavelength is on the order of 5 meters. Also, it is difficult to increase their directivity on airborne platforms by using multi-element arrays due to limited space on the aircraft. For these reasons, most airborne VHF antennas have low gain. One leaky wave structure is the so called trough waveguide antenna, but it does not have the same form factor and radiation aperture as an antenna embodying this invention.

It would therefore be advantageous to provide a compact high gain antenna useful for airborne applications.

SUMMARY OF THE INVENTION

A leaky wave slotline antenna is described. In a general sense, according to one aspect of the invention, the antenna includes a waveguide having top and bottom walls, and a slot defined in the top wall along a center longitudinal axis. The top wall comprises a first top wall portion and a second top wall portion, the first and second top wall portions separated by the slot. The antenna further includes means for exciting the slotline in anti-phase to launch a TE20 mode. The slotline exciting means can include, for example, a first probe connected to the first top wall portion, a second probe connected to the second top wall portion, and means for exciting the first and second probes with antiphase signals. The waveguide can be dielectrically loaded to further reduce the thickness of the waveguide.

This invention offers a high gain approach to provide a line source with a thin profile, which is compatible with the wing structure so that it has minimum impact on the aerodynamics for the aircraft. This invention may be used to replace other designs such as Yagi, dipoles, cross loops, polyrods, and Rhombic antennas for low frequency applications.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 shows slotline antennas in accordance with the invention, respectively mounted underneath the wings of an aircraft.

FIG. 7 is an end view of the slotline antenna of FIG. 6, showing the dimensions a and b.

FIG. 8 is a simplified end view of the slotline antenna of FIG. 6, showing the probes for exciting the top wall portions out of phase.

FIG. 9 is an isometric view showing the field pattern for the antenna of FIG. 8.

FIG. 10 shows numerical data for an exemplary VHF antenna in accordance with the invention.

DETAILED DESCRIPTION OF THE PREFERRED EMBODIMENT

A compact high gain VHF antenna for airborne synthetic aperture radar to detect targets concealed behind trees and forests. The antenna is formed by cutting a slotline in the middle of the top wall of a very thin waveguide along its axis. The waveguide can be folded and mounted on the underside of the wings of an aircraft with minimum protrusion and wing drag. The antenna produces a downward and side-looking beam with horizontal polarization for maximum foliage penetration and target detection. The antenna design can be scaled to any frequency for ground based and shipboard applications.

Figure 1:
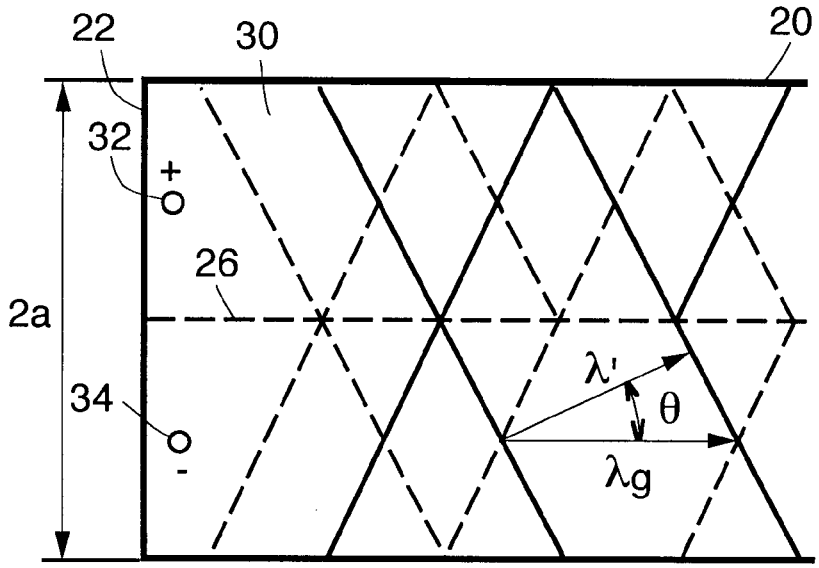
FIG. 1 shows a thin waveguide excited by two antiphase probes at one end to launch a TE20 mode.
Figure 2:
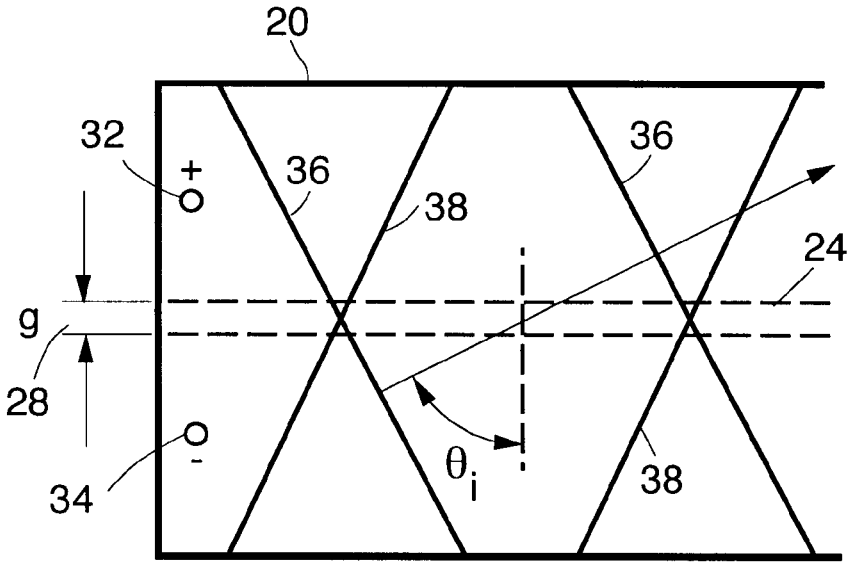
FIG. 2 shows the waveguide of FIG. 1 with a narrow slotline cut in its top wall in accordance with the invention.
Figure 3:
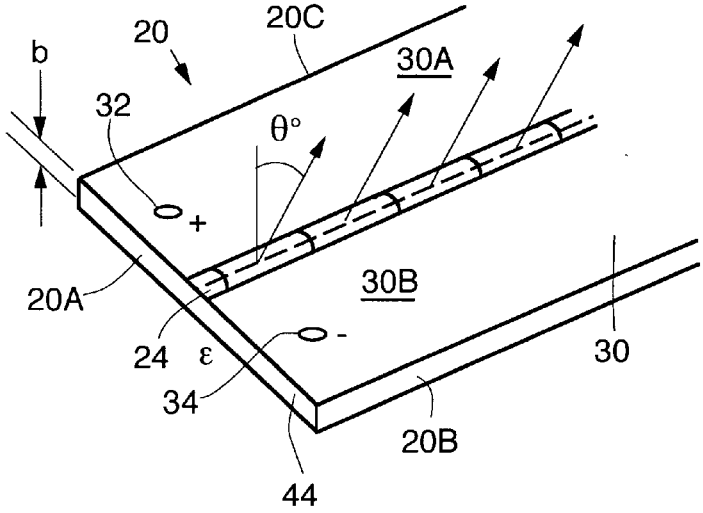
FIG. 3 shows a wave emerging from the slotline of the antenna of FIG. 2, with its wavefront tilting from the boresight with an exit angle $\theta_0$.

An antenna in accordance with an aspect of the invention is formed by cutting a slotline in the middle of a very thin waveguide along its longitudinal axis. To understand the principle of this slotline antenna, a brief review of the wave propagation in a waveguide is in order. Exciting a waveguide by a probe mounted along its center axis at one end would excite the TE10 mode. Consider a thin waveguide 20, as shown in FIGS. 1–3, excited by two anti-phase probes 32, 34 at one end 22 and offset from the center axis 26. The waveguide 20 will be defined along its longitudinal extent by a bottom wall 20A, a top wall 30, side walls 20B and 20C (FIG. 3). The probes will launch a TE20 mode, which can be considered as a superposition of two symmetrically offset plane waves propagating at an angle +/−θ with respect to the axis. The angle θ is defined by $$\cos\theta = \lambda'/\lambda_g \tag{1}$$

where $\lambda' = \lambda_0/n$, with n being the index of refraction, equal to the square root of the dielectric constant of the loading material filling the waveguide cavity, and $\lambda_g$ is the guide wavelength given by $$\lambda_g = \frac{\lambda'}{\sqrt{1-(\lambda'/2a)^2}} \tag{2}$$

where $2a$ is the broad dimension of the waveguide 20. From these two equations one can determine the angle θ, which is also the direction of the surface current induced by each plane wave.

When a slotline 24 is cut along the central axis 26 of the waveguide 20 of the top wall 30, as illustrated in FIG. 2, the surface current is interrupted by the gap 28, creating a displacement current across the slotline. The surface current associated with the component represented by the solid lines 36 points in one direction (+θ), while that of the other component represented by the dashed lines 38 points in an opposite direction (−θ) but 180 degrees out of phase. These two set of currents induce an electric field across the gap 28 in a push-pull manner, which is the excitation source of the slotline antenna in accordance with the invention.

As the wave emerges from the slotline 24, as shown in FIG. 3, its wavefront will tilt from the boresight with an exit angle $\theta_0$, which is constrained by the Snell's law $$\sin\theta_0 = n \sin\theta_i \tag{3}$$

where $\theta_i$ is related to θ by $\cos\theta = \sin\theta_i$. For given dimension a, operating frequency, and the dielectric constant of the dielectric material 44 in the waveguide, one can compute the exit angle and all other parameters in the above equations. The dielectric material is used to reduce the thickness (dimension b) of the waveguide, thus making the antenna even more compact.

The coupling coefficient of the radiated wave with respect to the field inside the guide is controlled by the ratio of the gap size, g, and the thickness of the waveguide, b, because the junction behaves as a voltage divider for the incident field propagating across the gap. The gain and beamwidth of the antenna pattern in the H-plane are functions of the line source length L.

Figure 4:
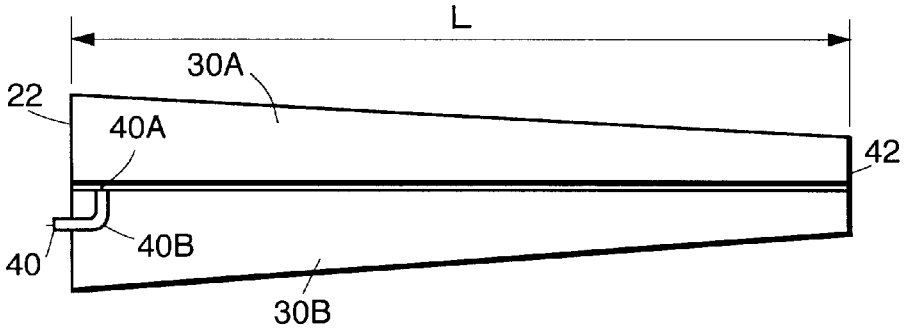
FIG. 4 is a top view of a slotline antenna in accordance with the invention, wherein the coupling ratio is varied by varying the width of the waveguide from one end of the antenna to the other.
Figure 5:
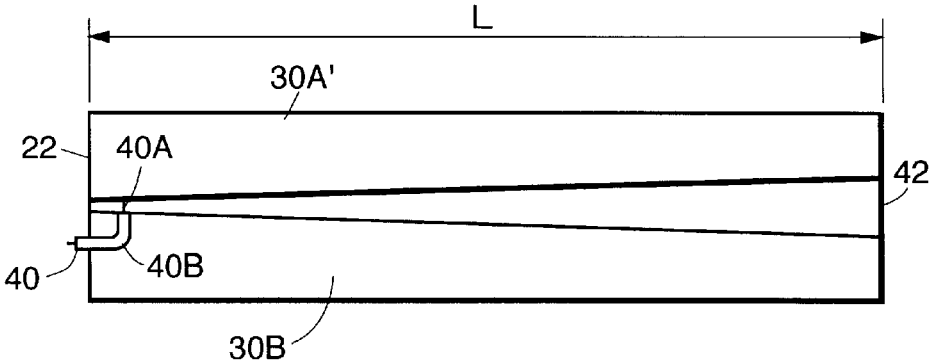
FIG. 5 is a top view of a slotline antenna in accordance with the invention, wherein the coupling ratio is varied by varying the width of the slotline gap from one end of the antenna to the other.
Figure 11A:
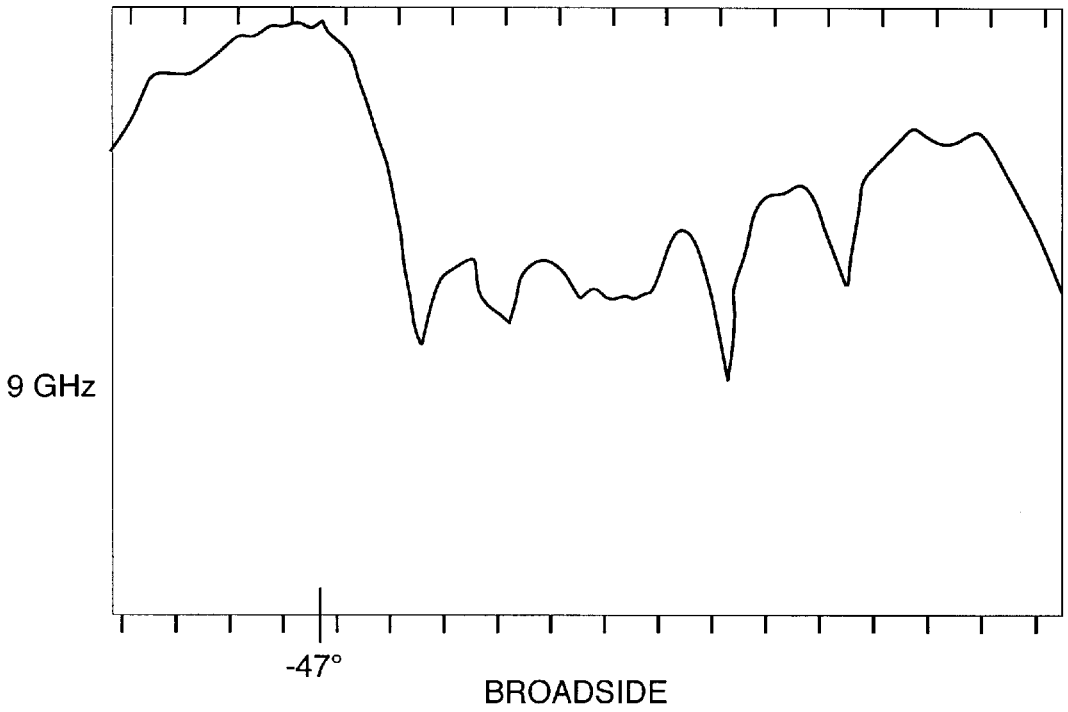
FIGS. 11A–D shows patterns of an H-plane cut (along the axis of the slotline) for an X-band embodiment of the invention.
Figure 11B:
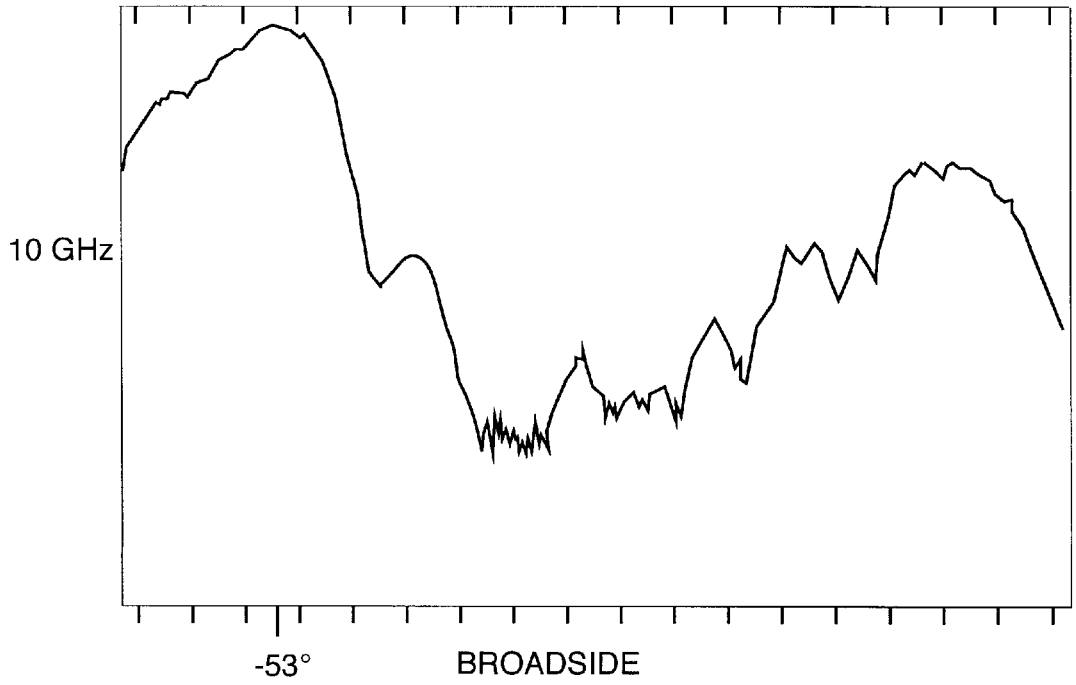
Figure 11C:
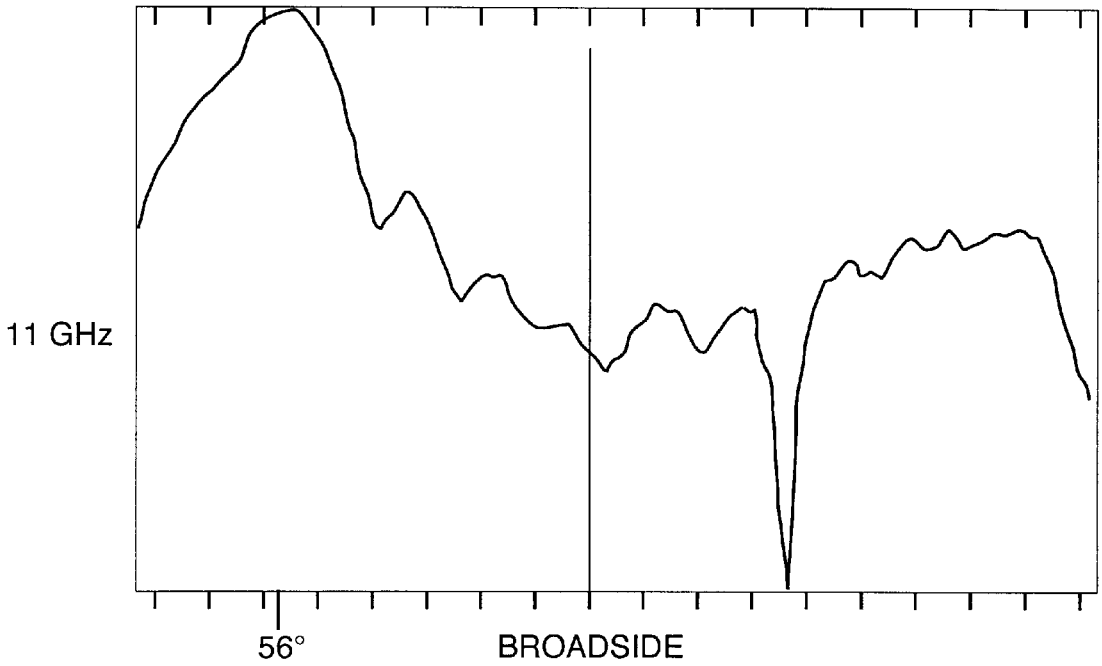
Figure 11D:
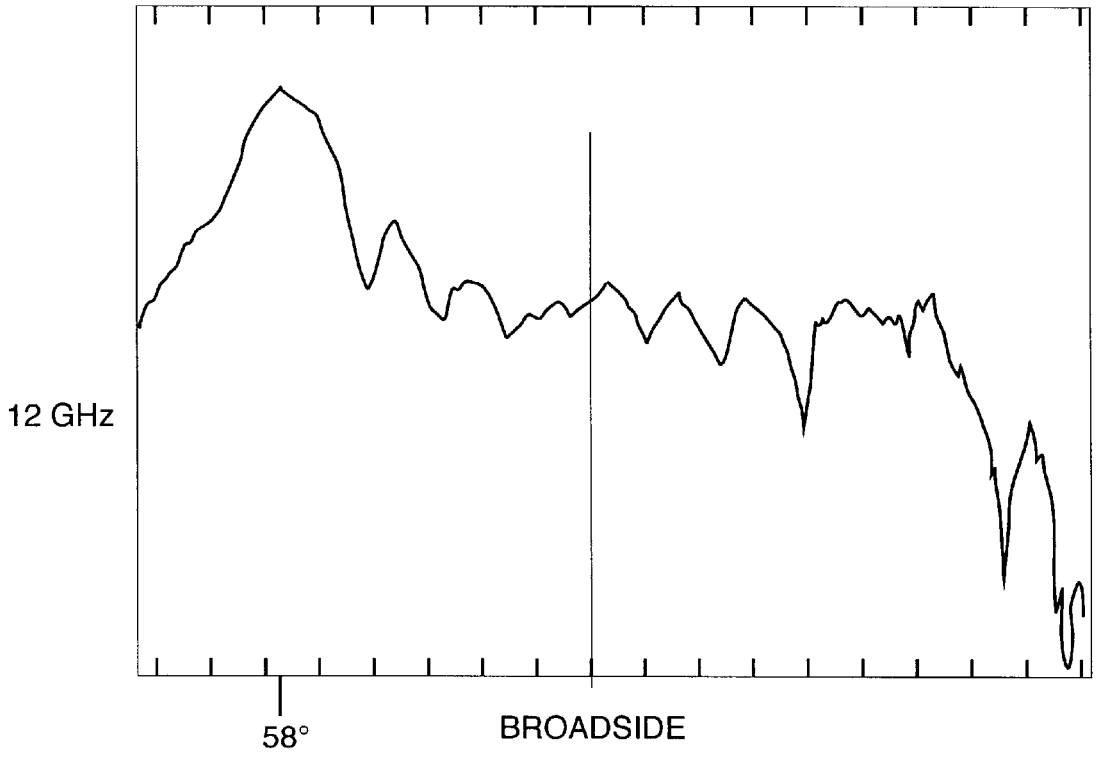

The slotline may be excited by using two probes 32, 34 as in FIG. 1, or simply by a coaxial line 40 across the gap as shown in FIGS. 4 and 5. The center conductor 40A of the line is connected to one side 30A of the top wall 30, and the outer shield 40B of the line is connected to the other side 30B of the top wall. The coupling ratio along the slotline 24 can be controlled by varying the dimension a of the waveguide, as shown in FIG. 4, or the gap distance g as illustrated in FIG. 5. In the embodiment of FIG. 4, the dimension a of the waveguide is reduced from its size at end 22 to the opposite end 42. In the embodiment of FIG. 5, the gap size g increases from its initial size at end 22 to its larger size at the opposite end.

FIG. 6 shows slotline antennas 100A and 100B in accordance with the invention, respectively mounted underneath the wings 52 and 54 of an aircraft 50. FIG. 7 is an end view of the slotline antenna, showing the dimensions a and b. FIG. 8 is a simplified end view of the slotline antenna 100A, showing the probes 102A and 104A for exciting the slotline out of phase. The probes in this embodiment are coaxial, with the center conductor extending through an opening in the bottom wall of the waveguide to the top wall of the waveguide, where the center conductor makes electrical contact. The outer shield of the probe is connected to the bottom wall of the waveguide. FIG. 9 is an isometric view showing the field pattern for the antenna of FIG. 8.

FIG. 10 provides numerical data for an example of a VHF antenna as illustrated in FIG. 6, and with a length dimension L of 35 feet.

Figure 12:
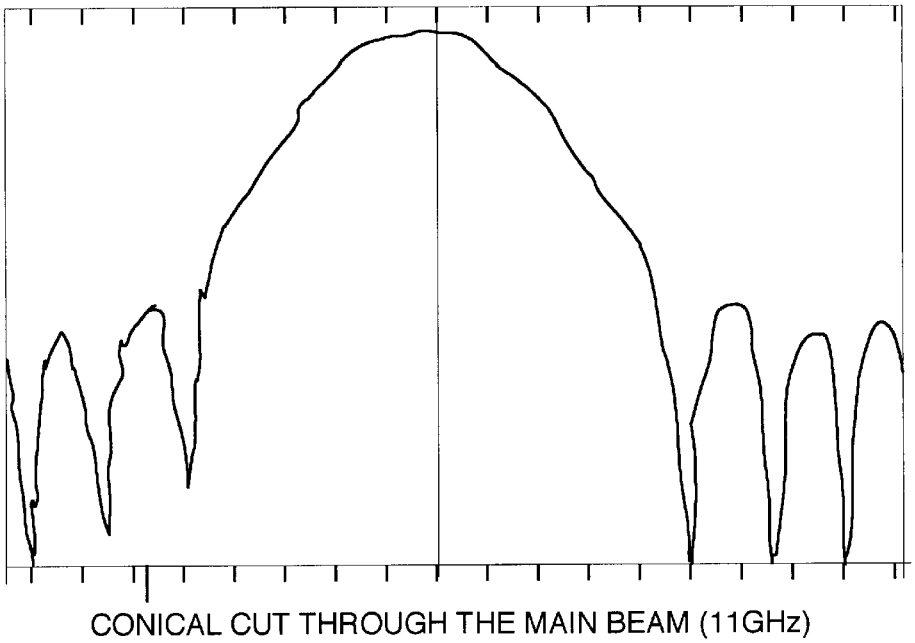
FIG. 12 shows a conical cut through the main beam at 11 GHz for the X-band embodiment of FIG. 11.

A scale model of an antenna in accordance with the invention, operating at X-band, has been built and tested. The model had a thickness b=0.265 inch, length L of the antenna=5.25 inches, width 2*a* of the antenna waveguide=1.95 inches, a slotline gap=0.225 inch, and the center pins of the probes were 0.5 inch from the edge of the waveguide. Antenna patterns were measured in a roof top range. Patterns of an H-plane cut (along the axis of the slotline) at 9, 10, 11 and 12 GHz are shown in FIGS. 11A–11D, respectively. A conical cut through the main beam at 11 GHz is given in FIG. 12.

Figure 13A:
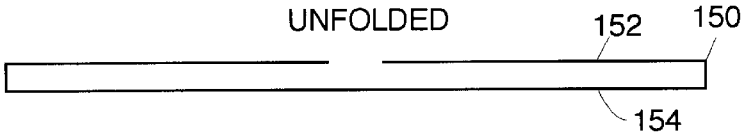
FIG. 13A shows a slotline antenna embodying the invention in cross-section, wherein the waveguide is unfolded.
Figure 13B:
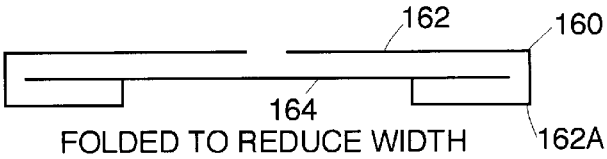
FIG. 13B shows a slotline antenna embodying the invention, but wherein the waveguide is folded to reduce the width of the antenna.

To reduce the width of the waveguide, the waveguide can be folded. This is illustrated in FIGS. 13A and 13B. FIG. 13A shows a slotline antenna embodying the invention in cross-section, wherein the waveguide 150 is unfolded, i.e., the waveguide top and bottom walls 152 and 154 consist of single top and bottom planar surface members. Now consider the slotline antenna of FIG. 13B, also embodying the invention, but wherein the waveguide 160 is folded to reduce the width of the antenna. The waveguide top wall 162 folds around the end of the bottom wall 164 so that a portion of the bottom wall at each side of the waveguide also serves as a top wall, and the folded portion 162A forms a bottom wall. The effective electrical width dimension of the folded waveguide antenna can be made the same as the unfolded version, but with a reduced width. This folded embodiment can be employed in an airborne system as well.

It will be appreciated by those skilled in the art that principles of reciprocity apply to the leaky wave slotline antenna described herein, and that the antenna can be employed on receive as well as on transmit. On receive, the signal received at one probe is phase shifted by 180 degrees, and then combined with the signal received at the other probe.

Figure 14:
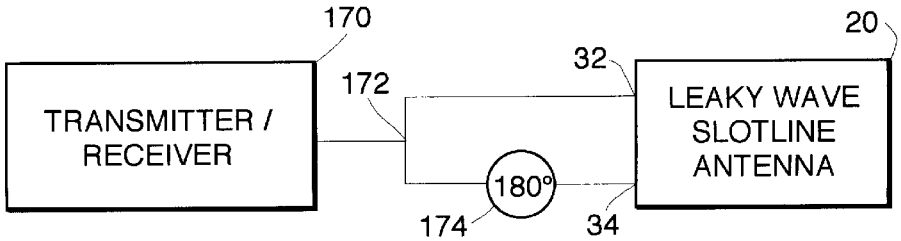
FIG. 14 is a general block diagram of a system utilizing the leaky wave slotline antenna 20.

FIG. 14 is a general block diagram of a system utilizing the leaky wave slotline antenna 20. In general, a transmitter or receiver, indicated as element 170, is connected to the antenna 20 through a power divider/combiner 172, which divides the transmitter signal equally or combines the signals on receive, for connection to the probes 32 and 34. To achieve the 180 degree phase difference in the drive signals applied to the probes, a 180 degree phase shifter is included in the transmission line to the probe 34. On receive, the device 172 acts as a power combiner for combining the signals from port 32 and the signals from port 34 phase shifted by device 174.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A leaky wave slotline antenna, comprising:

a waveguide having top and bottom walls, and a slot defined in said top wall along a center longitudinal axis, said top wall comprising a first top wall portion and a second top wall portion, said first and second top wall portions separated by said slot; and means for exciting the slotline in antiphase to launch a TE20 mode, wherein said means for exciting the slotline includes a first probe connected to said first top wall portion, a second probe connected to said second top wall portion, and means for exciting the first and second probes with antiphase signals, wherein said first probe includes a first center conductor connected to said first top wall portion, and a first outer shield conductor connected to said bottom wall, and wherein said second probe includes a second center conductor connected to said second top wall portion, and a second outer shield conductor connected to said bottom wall.

2. The antenna of claim 1 wherein said means for exciting comprises a coaxial line comprising a center conductor connected to said first top wall portion and an outer conductor connected to said second top wall portion.

3. The antenna of claim 1 further comprising dielectric material disposed in the waveguide between said top and bottom walls.

4. The antenna of claim 1 wherein said means for exciting comprises means for exciting the slotline with signals in the VHF frequency range.

5. The antenna of claim 1 wherein the width of the slotline varies from a first end of the antenna to a second end of the antenna.

6. The antenna of claim 1 wherein the width of the top wall of the waveguide varies from a first end of the antenna to a second end of the antenna.

7. A leaky wave slotline antenna, comprising:

a waveguide having top and bottom walls, and a slot defined in said top wall along a center longitudinal axis, said top wall comprising a first top wall portion and a second top wall portion, said first and second top wall portions separated by said slot;

a first probe connected to the first top wall portion;

a second probe connected to the second top wall portion; and combining circuitry connected to the first and second probes for combining respective first and second probe signals in antiphase to provide an antenna receive signal;

wherein said first probe includes a fist center conductor connected to said first top wall portion, and a fist outer shield conductor connected to said bottom wall, and wherein said second probe includes a second center conductor connected to said second top wall portion, and a second outer shield conductor connected to said bottom wall.

8. The antenna of claim 7 further comprising dielectric material disposed in the waveguide between said top and bottom walls.

9. The antenna of claim 7 wherein said antenna receive signal is in the VHF frequency range.

10. The antenna of claim 7 wherein the width of the slotline varies from a first end of the antenna to a second end of the antenna.

11. The antenna of claim 7 wherein the width of the top wall of the waveguide varies from a first end of the antenna to a second end of the antenna.

12. A leaky wave slotline antenna, comprising:

a waveguide having top and bottom walls, and a slot defined in said top wall along a center longitudinal axis, said top wall comprising a first top wall portion and a second top wall portion, said first and second top wall portions separated by said slot, wherein the waveguide is folded, thereby providing a reduction in width of the waveguide; and means for exciting the slotline in antiphase to launch a TE20 mode.

13. The antenna of claim 12 wherein said means for exciting the slotline includes a first probe connected to said first top wall portion, a second probe connected to said second top wall portion, and means for exciting the first and second probes with antiphase signals.

14. The antenna of claim 13 wherein said first probe includes a first center conductor connected to said first top wall portion, and a first outer shield conductor connected to said bottom wall, and wherein said second probe includes a second center conductor connected to said second top wall portion, a and a second outer shield conductor connected to said bottom wall.

15. The antenna of claim 12 wherein said means for exciting the slotline comprises a coaxial line comprising a center conductor connected to said first top wall portion and an outer conductor connected to said second top wall portion.

16. The antenna of claim 12 further comprising dielectric material disposed in the waveguide between said top and bottom walls.

17. The antenna of claim 12 wherein said means for exciting the slotline with signals in the VHF frequency range.

18. The antenna of claim 12 wherein the width of the top wall of the waveguide varies from a first end of the antenna to a second end of the antenna.

19. The antenna of claim 12 wherein the width of the top wall of the waveguide varies from a first end of the antenna to a second end of the antenna.

20. A leaky wave slotline antenna, comprising:

a waveguide having top and bottom walls, and a slot defined in said top wall along a center longitudinal axis, said top wall comprising a first top wall portion and a second top wall portion, said first and second top wall portions separated by said slot, wherein the waveguide is folded, thereby providing a reduction in width of the waveguide;

a first probe connected to the first top wall portion;

a second probe connected to the second top wall portion; and combining circuitry connected to the first and second probes for combining respective first and second probe signals in antiphase to provide an antenna receive signal.

21. The antenna of claim 20 wherein said first probe includes a first center conductor connected to said first top wall portion and a first outer shield conductor connected to said bottom wall, and wherein said second probe includes a second center connector connected to said second top wall portion, and a second outer shield conductor connected to said bottom wall.

22. The antenna of claim 20 further comprising dielectric material disposed in the waveguide between said top and bottom walls.

23. The antenna of claim 20 wherein said antenna receive signal is in the VHF frequency range.

24. The antenna of claim 20 wherein the width of the slotline varies from a first end of the antenna to a second end of the antenna.

25. The antenna of claim 20 wherein the width of the top wall of the waveguide varies from a first end of the antenna to a second end of the antenna.

* * * * *